US007574823B2

(12) United States Patent
Nakayama

(10) Patent No.: US 7,574,823 B2
(45) Date of Patent: Aug. 18, 2009

(54) QUICK CHANGE BARREL SYSTEM FOR A FIREARM

(75) Inventor: Brian Nakayama, Lakewood, CO (US)

(73) Assignee: Magpul Industries Corp., Erie, CO (US)

( * ) Notice: Subject to any disclaimer, the term of this patent is extended or adjusted under 35 U.S.C. 154(b) by 0 days.

(21) Appl. No.: 12/013,401

(22) Filed: Jan. 11, 2008

(65) Prior Publication Data

US 2008/0168695 A1 Jul. 17, 2008

Related U.S. Application Data

(60) Provisional application No. 60/884,615, filed on Jan. 11, 2007.

(51) Int. Cl.
*F41A 21/00* (2006.01)

(52) U.S. Cl. ..... 42/75.02; 42/75.01; 42/75.04

(58) Field of Classification Search ..... 42/75.01, 42/75.02, 75.04
See application file for complete search history.

(56) References Cited

U.S. PATENT DOCUMENTS 529,455 A * 11/1894 Marlin ..... 42/75.02
4,519,156 A * 5/1985 Shaw ..... 42/77
4,920,679 A * 5/1990 Sarles et al. ..... 42/75.02
4,999,939 A * 3/1991 Reese et al. ..... 42/40
5,020,260 A * 6/1991 Houghton ..... 42/75.02
6,571,676 B1 6/2003 Folsom et al.
6,606,812 B1 8/2003 Gwinn, Jr.
6,655,372 B1 12/2003 Field et al.
6,752,061 B2 6/2004 Knorich et al.
6,874,268 B2 4/2005 Baumann
7,104,000 B2 * 9/2006 Orth ..... 42/71.01
7,137,219 B2 11/2006 Wossner et al.
2004/0103575 A1 * 6/2004 Rousseau et al. ..... 42/75.02

OTHER PUBLICATIONS

Zinmba, Jeff W., "The QCB Upper Receiver for the AR-15/M16/M4", the Small Arms Review, vol. 8, No. 3, Dec. 2004, pp. 37-40.

* cited by examiner

*Primary Examiner*—Michael Carone
*Assistant Examiner*—Samir Abdosh
(74) *Attorney, Agent, or Firm*—Geoffrey E. Dobbin

(57) ABSTRACT

The present invention is an improved quick change barrel system for a firearm. It features an interlocking trunnion and lock ring that hold the barrel in place proximate the receiver. Intermittent threading provides multiple points of interface. A foldable handle is provided to allow safe removal of the lock ring and additional torque for attachment and removal of the lock ring from the system.

6 Claims, 7 Drawing Sheets

QUICK CHANGE BARREL SYSTEM FOR A FIREARM

CROSS-REFERENCES TO RELATED APPLICATIONS

This Application claims priority as a non-provisional perfection of prior filed U.S. Provisional Application 60/884,615, filed on Jan. 11, 2007 and incorporates the same by reference in its entirety.

FIELD OF THE INVENTION

The present invention relates to the field of firearms and more particularly relates to a new rifle platform with enhanced utility innovative components and increased modularity.

BACKGROUND OF THE INVENTION

Prior firearms have been, as a whole, adequate for their purposes. However, the advent of improved technologies in other fields, combined with the demands of current military tactics, both offensive and defensive, have created a need for a firearm that improves upon the current designs in the art. Practically speaking, the need has arisen for a lighter and more efficient weapon; one that is easily maintained, simple to operate and assemble, and easily enhanced as need requires.

Of particular need is a quick change barrel system. Quickly changeable barrel systems are well known in the field of crew-served weapons such as machine-guns. These weapons are primarily belt-fed, fully-automatic, operate with an open-bolt mechanism and are intended to be used in roles requiring maximum firepower. Due to the quantity and rate of fire, these weapons generate a significant amount of heat, primarily in the barrel and gas operating system (if one is present). The temperatures generated significantly affect weapon function by burning off lubricating oils, altering critical tolerances as parts expand at differential rates (depending on material), and temporarily and/or permanently weakening structural materials. This may cause various malfunctions including critical weapon failure (feeding & extraction failures, blown barrels, bolt failure etc.). To avoid these affects, cooling systems such as fins, fluting, increased forced air convection and water cooling have been employed historically. However, these systems can have various drawbacks including low effectiveness, weight, bulk, complexity and cost. Because of this, modern machine-guns such as the US M60 GPMG, FN MAG/M240 GPMG, and M2HB-QCB all utilize quick-change barrel (QCB) systems to completely replace a hot barrel with a fresh one.

Rifles are not expected to generate the heat levels seen on machine-guns. Therefore rifle barrels have traditionally been considered an integral part of the firearm. Barrels were never intended to be readily removed especially at the operator level. While this approach has worked historically, this type of design has imposed a number of limitations on these systems. With increased detachable box magazine capacity, lighter ammunition and the demands of high-end users such as special forces operators, rifles are experiencing heat issues similar to machine-guns. QCB systems allow similar barrel swaps to prolong weapon use under intense operational circumstances.

These limits have given rise to rifle systems and modifications designed to allow users to change the barrel. Systems such as the LMT Monolithic Rail Platform (MRP) and FN SCAR attach the barrel with a number of screws requiring additional tooling in order to operate. Other systems are true QCB systems such as the Leitner-Wise Modular Weapon System (MWS) and MGI Hydra that incorporate two-point lateral lever or cam systems which mount the barrel and allow quick change ability without tools. The benefits of such systems are numerous and include mission adaptability, easier serviceability, easier caliber change of the weapon, and more compact storage.

The present invention is an improved QCB system with numerous improvements that make it simpler to operate and maintain as compared to the prior art.

SUMMARY OF THE INVENTION

In view of the foregoing disadvantages inherent in the known types of barrel systems, this invention provides an improved quick change barrel system with increased utility, intuitive use and rapid deployment. As such, the present invention's general purpose is to provide a new and improved quick change barrel system that is more efficient to operate and maintain, and presents an intuitive interface for users.

To accomplish these objectives, the quick change barrel system comprises a barrel which is mounted in a cantilevered manner. The rear of the barrel slides and mounts into a barrel trunnion and is subsequently locked into place with a barrel lock ring via an interrupted, non-continuous thread that mates with the barrel trunnion. A folding wire handle is provided to assist in applying leverage to turn the barrel lock ring thereby applying pressure to the barrel extension flange and providing a sealed joint. A spring-loaded detent (barrel lock plunger) locks into grooves on the barrel lock ring to prevent it from working loose.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

With reference now to the drawings, the preferred embodiment of the firearm is herein described. It should be noted that the articles "a", "an" and "the", as used in this specification, include plural referents unless the content clearly dictates otherwise.

Figure 1:
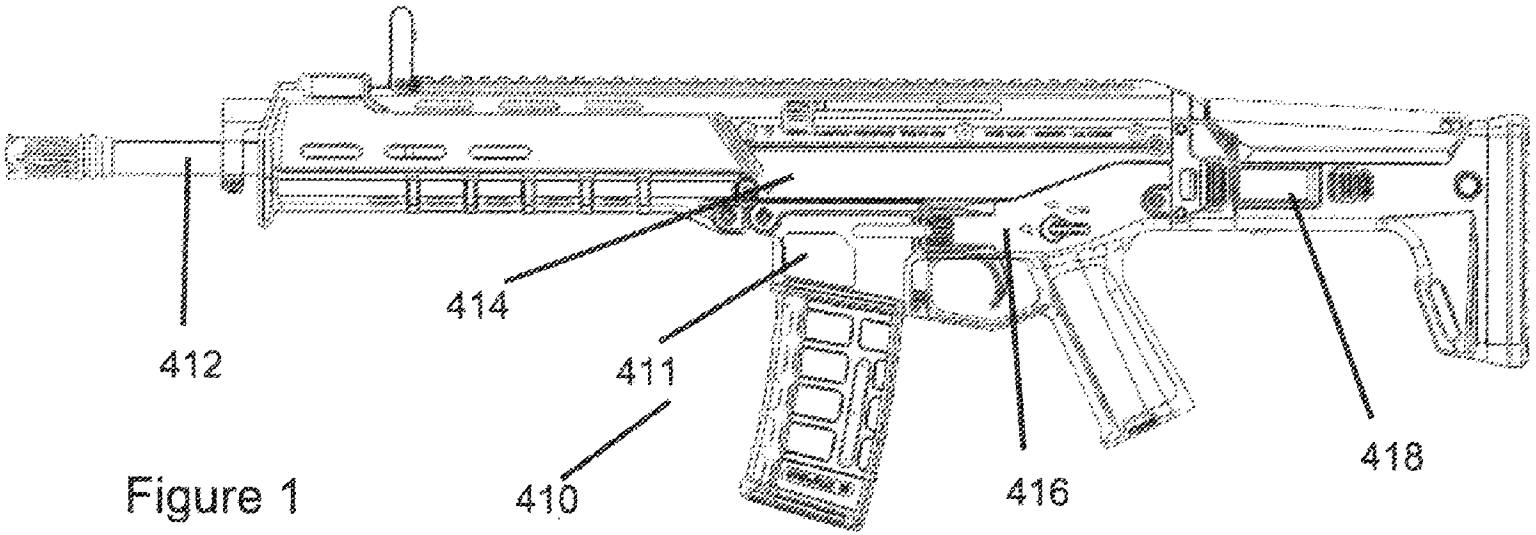
FIG. 1 is a left plan view of a firearm utilizing a quick change barrel system according to the present invention.
Figure 2:
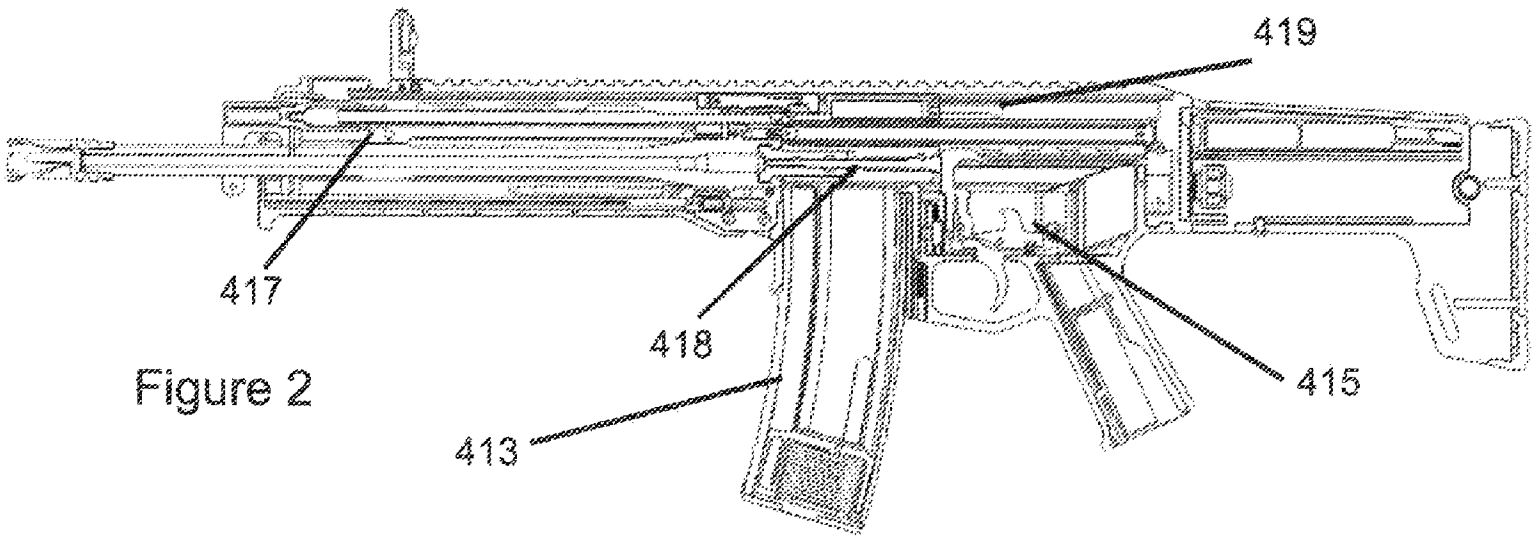
FIG. 2 is a cross-sectional view of the firearm of FIG. 1.

With reference to FIG. 1, the firearm 10, as disclosed in the parent provisional application, has four major components, namely the barrel 412, receiver 414, grip housing 416 and stock 418. Internal parts are generally located in the receiver 414 and grip housing 416. FIG. 2 depicts a trigger control group 415 and a magazine 413 as residing in the grip housing 416 and a short stroke gas piston system 417 and charging system 419 in the receiver 414. The firing pin 418 is also located in the receiver 414.

Figure 3:
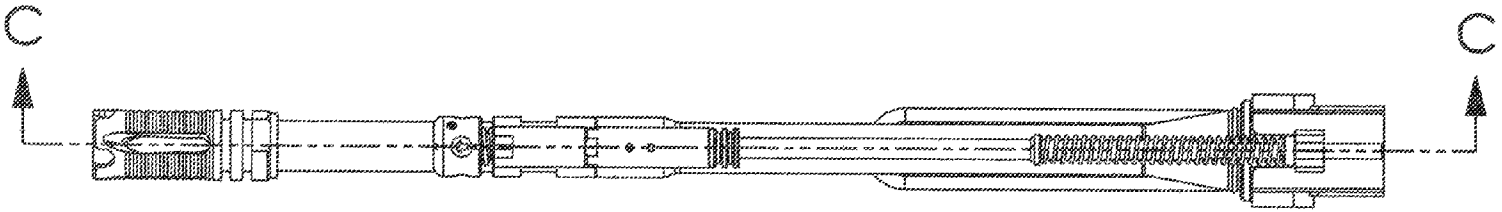
FIG. 3 is a top plan view of the barrel assembly according to the present invention
Figure 4:
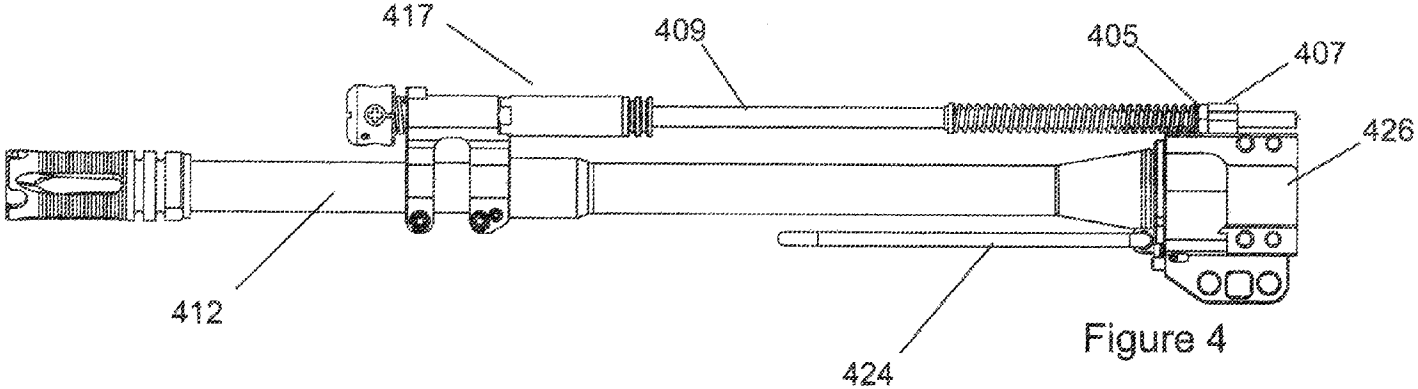
FIG. 4 is a left plan view of the barrel assembly of FIG. 3
Figure 5:
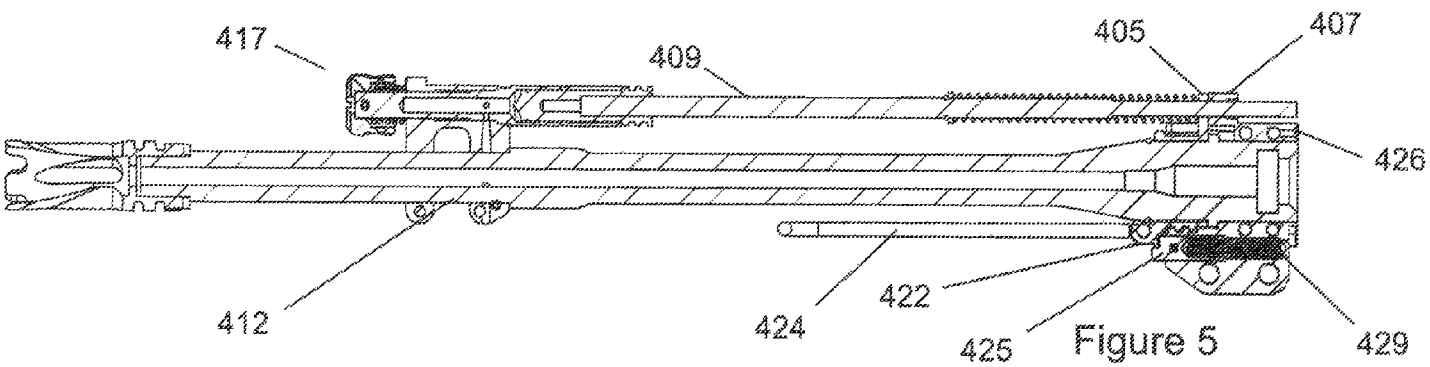
FIG. 5 is a sectional view of the barrel assembly of FIG. 3, taken along line C-C.
Figure 6:
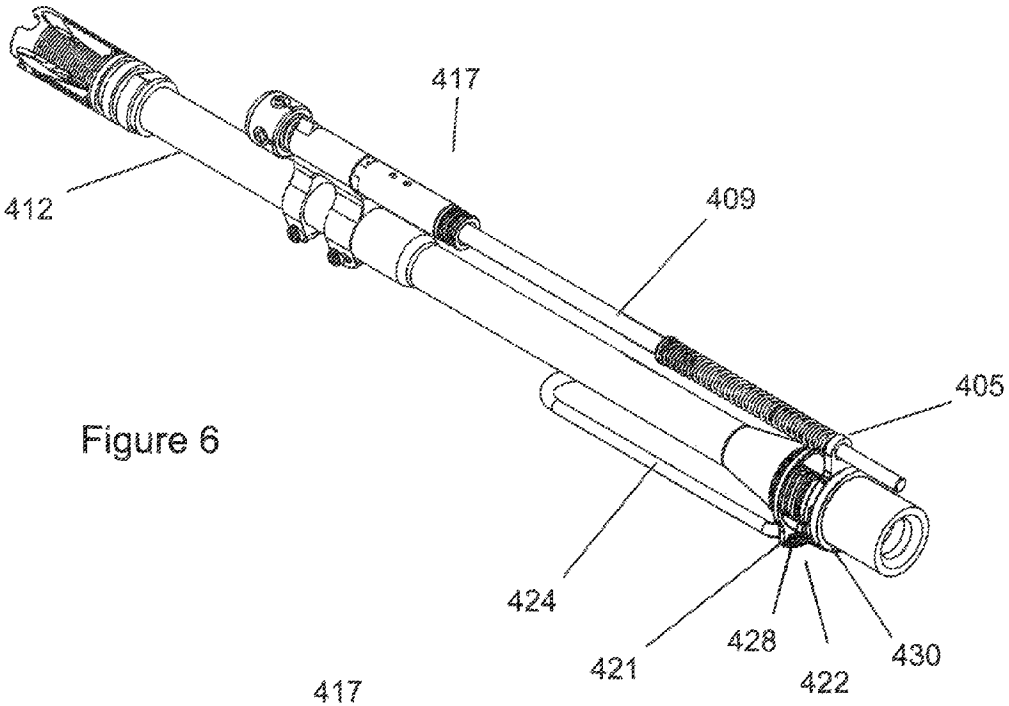
FIG. 6 is a perspective view of the barrel assembly of the present invention, without the barrel trunnion.
Figure 7:
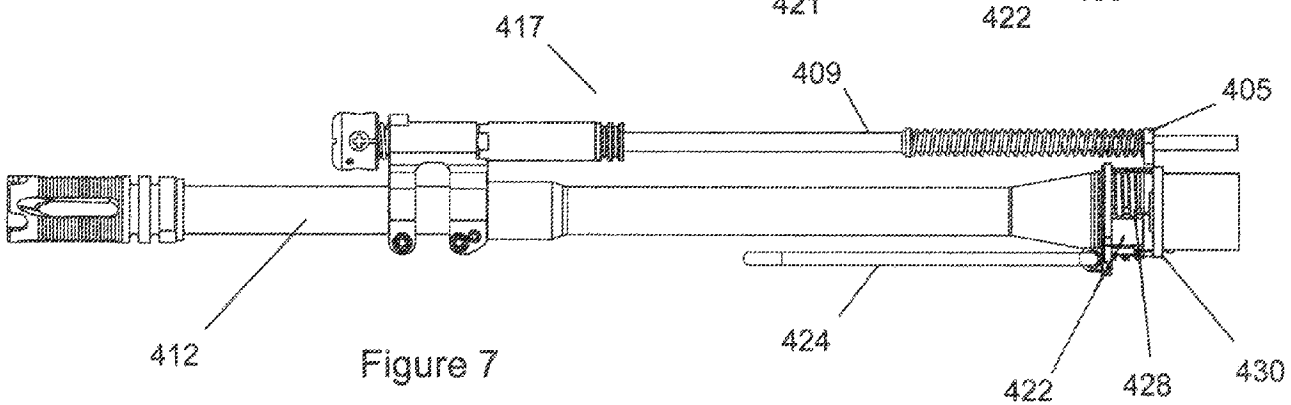
FIG. 7 is a left plan view of the barrel assembly of FIG. 6.

The firearm 410 has a free floating barrel 412 which is cantileverally attached to receiver 414 (FIG. 2). The barrel assembly itself is depicted in FIGS. 3-5. In these depictions, a stripped M-16/AR15 barrel is used. In the present invention, barrel 412 is mounted upon a lock ring 422 which interfaces with the barrel trunnion 426. It should be noted that the barrel 412 is not fused to the lock ring 422, so that generic barrels, with flanges 430 (FIGS. 6 and 7), may be used with this invention. A foldable wire handle 424 extends from the lock ring 422 to aid in assembly and disassembly of the barrel structure from the firearm. Mounted over the barrel 412 is the gas piston assembly 417, which comprises, among other things, a piston rod 409. The piston rod 409 is held in place by two rod guides, one on the barrel 405, and the other on the barrel trunnion 407.

Figure 8:
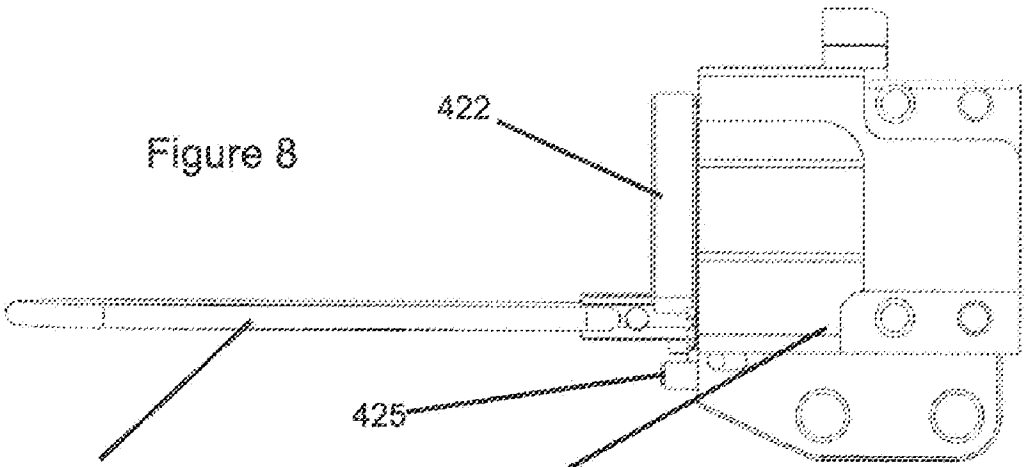
FIG. 8 is a left plan view of the lock ring and trunnion of the present invention, assembled.
Figure 9:
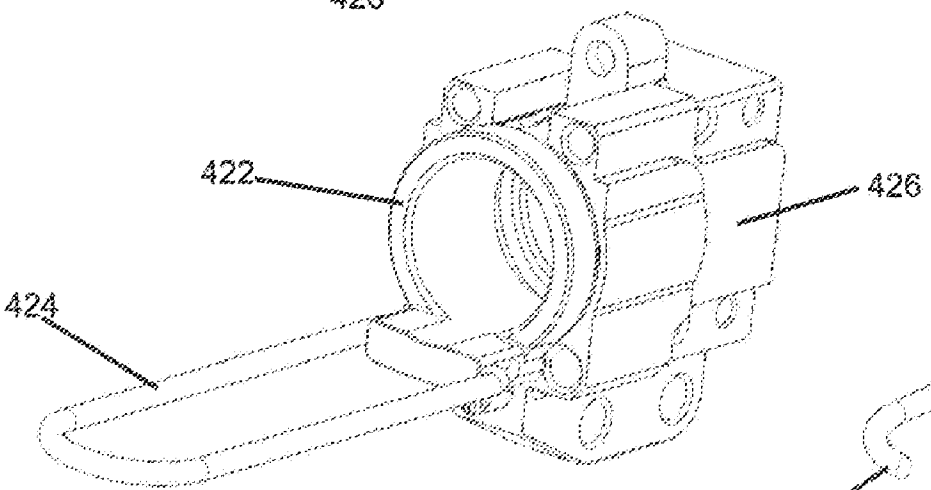
FIG. 9 is a perspective view of the lock ring and trunnion of FIG. 8.
Figure 10:
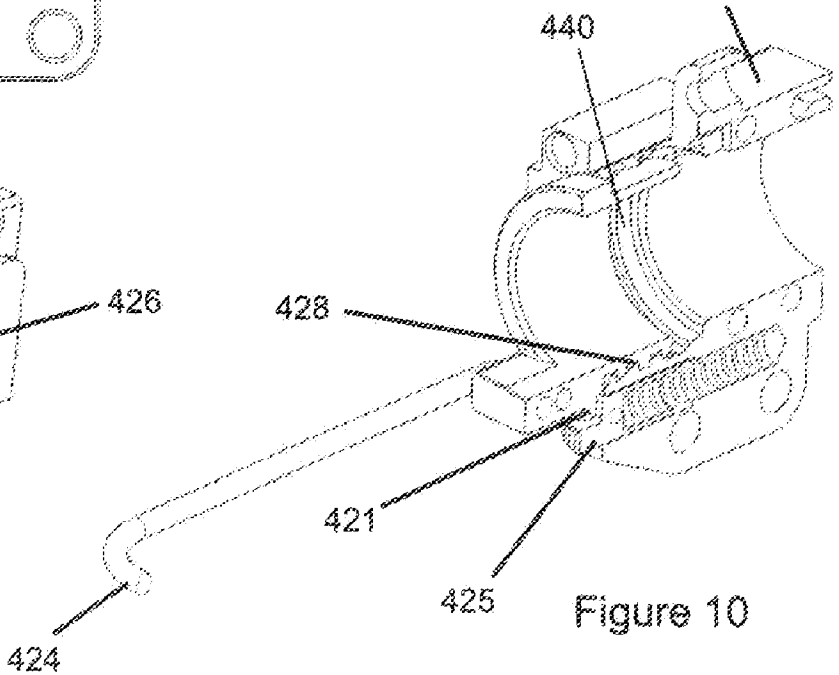
FIG. 10 is a cross-sectional view of the lock ring and trunnion of FIG. 9.
Figure 13:
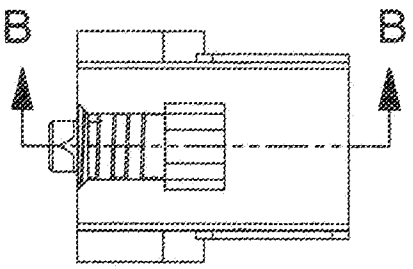
FIG. 13 is a top plan view of the barrel trunnion of FIG. 11
Figure 14:
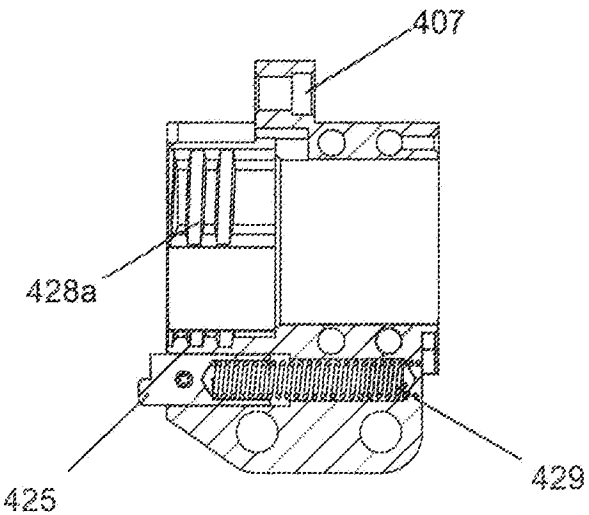
FIG. 14 is a sectional view of the barrel trunnion of FIG. 13, taken along line B-B.
Figure 12:
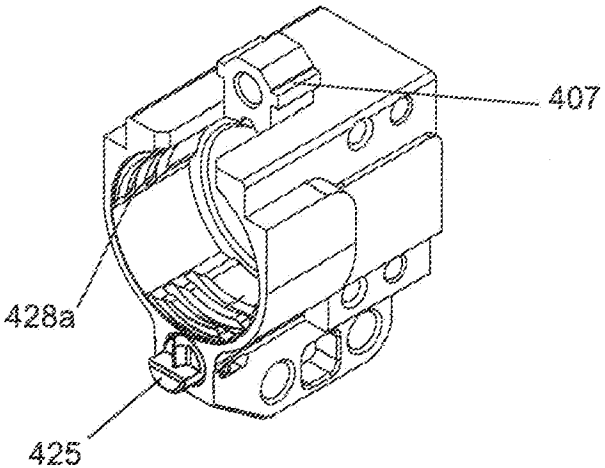
FIG. 12 is a perspective view of the barrel trunnion of FIG. 11

Barrel trunnion 426 and lock ring 424 have non-continuous, interrupted thread interfaces 428, 428*a* (best seen in FIGS. 6, 7, 12 and 14) and a locking structure to hold them together. The non-continuous, interrupted thread pattern is preferred as it provides points of quick attachment/detachment to further increase speed. The interruptions may provide as few as one such points, but it is preferred that three or more are used, with an ideal range of 3 to 5 such points. The preferred locking structure is a detent pin (or lock plunger) 425, biased by spring 429, which interfaces with flat ridges 421 on the lock ring 422 (one shown) to prevent rotation, thus keeping the lock ring 422 and barrel trunnion 426 together (FIGS. 8 and 10). These ridges 421 must, of course, be manufactured to coincide with the interrupted threads 428, 428*a*. When held together, the lock ring 422 and barrel trunnion 426 cam the barrel extension flange 430, and thus the entire barrel 412, in place, holding it along an entire 360° arc which is more secure than prior art designs and automatically centers the barrel 412 in the trunnion 426 and therefore keeps the barrel centered adjacent the firing chamber. Lock ring 422 and barrel trunnion do not interface to the point of totally abutting each other, but instead leave a space 440 for the barrel flange 430 and for the barrel rod guide 405 to extend out of the barrel trunnion 426. It should also be noted that lock ring 422 also provides a measure of heat sinking capability to the system to prolong use of the firearm without changing barrels.

Figure 11:
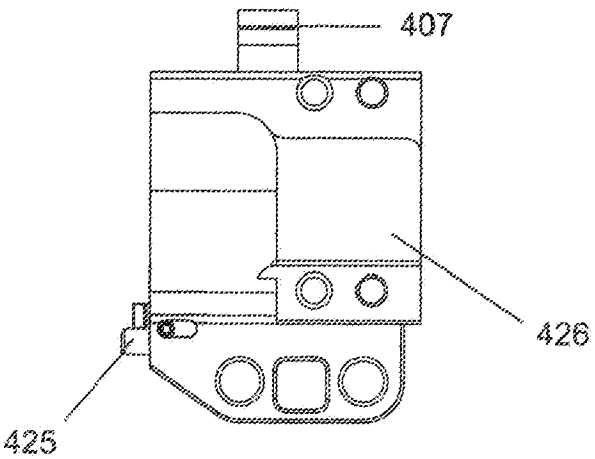
FIG. 11 is a left plan view of the barrel trunnion of the present invention.
Figure 15A:
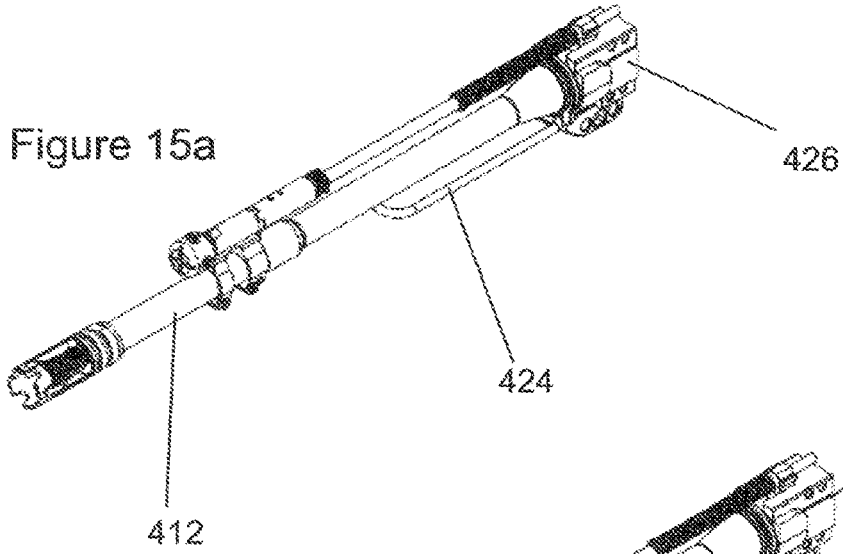
FIGS. 15*a*-15*d* are successive perspective views of the barrel assembly, depicting the disassembly of the present invention.
Figure 15B:
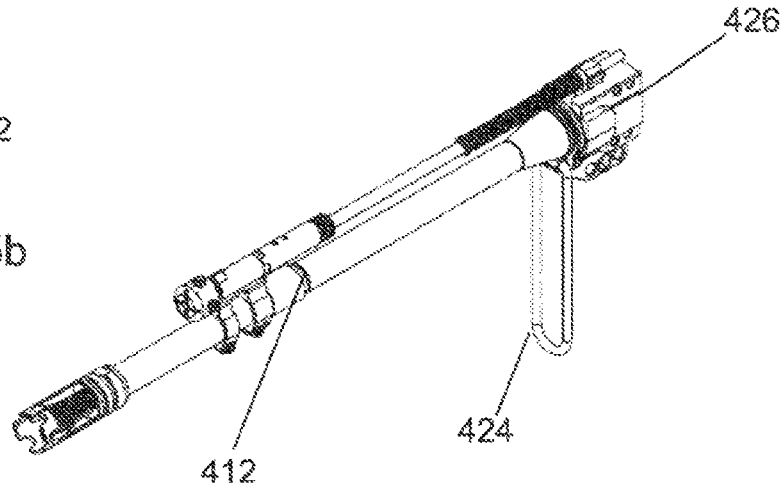
Figure 15C:
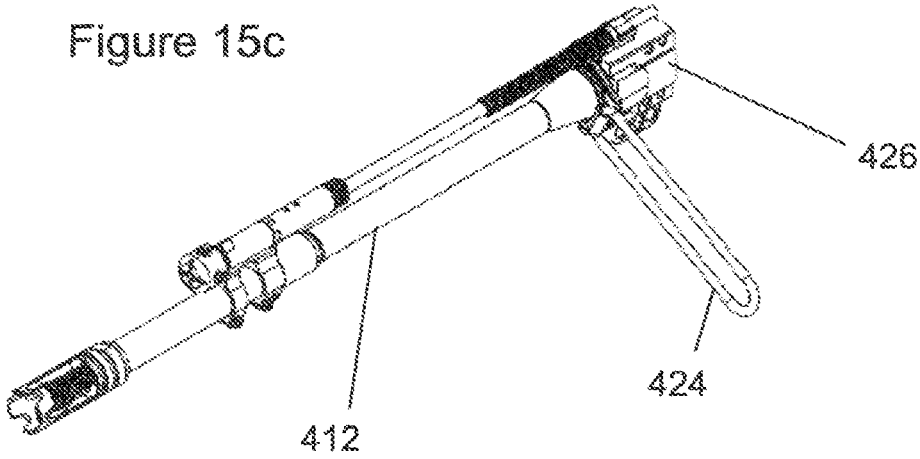
Figure 15D:
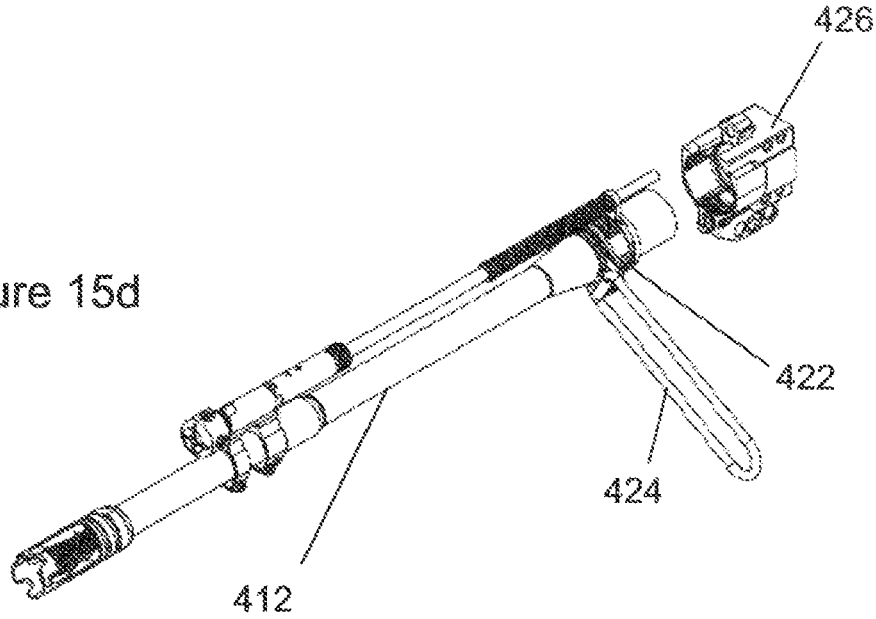

In use, depicted in FIGS. 15*a*-15*d*, the barrel 412 is held by the lock ring 422 and trunnion 426. The user unfolds the handle 424 and depresses the lock plunger (FIG. 11*b*). The user then rotates the handle 424 and associated lock ring 422 until it is freed from the trunnion 426 (FIG. 11*c*). At that point, the barrel 412 is removed from the trunnion 426 (FIG. 11*d*). It should be noted that the barrel 412 does not turn in this operation.

It should also be noted that the barrel trunnion 426 may be manufactured to accommodate any size, caliber, or type of rifle. As such, the barrel trunnion 426 may be manufactured to accommodate individual brand, model, and rifle specifications, including caliber, headspace.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. A quick connection barrel system for a firearm, comprising:

a. a barrel having an external flange proximate a rear end;

b. a barrel trunnion located in the firearm and having non-continuous interrupted threading;

c. a barrel lock ring located such that the flange is between the barrel lock ring and the barrel trunnion and having non-continuous interrupted threading to mate with non-continuous interrupted threading on the barrel trunnion with the flange still between the lock ring and the barrel trunnion;

wherein the barrel lock ring and barrel trunnion operate together to cam the flange in place so that the barrel, while held in place between the lock ring and barrel trunnion, is not otherwise attached to the lock ring.

2. The system of claim 1, further comprising a spring-biased locking pin and an interfacing surface, said surface located on a circumference of the barrel lock ring and the locking pin located in the barrel trunnion in a manner to engage the interfacing surface when the system is assembled and the locking pin is in its biased position.

3. The system of claim 2, the lock ring farther comprising a handle, radially spaced from a center point of the lock ring.

4. The system of claim 3, the handle being foldable along a length of the barrel when the system is assembled.

5. The system of claim 1, the lock ring farther comprising a handle, radially spaced from a center point of the lock ring.

6. The system of claim 5, the handle being foldable along a length of the barrel when the system is assembled.

* * * * *